US011638444B2

(12) United States Patent
Liu

(10) Patent No.: US 11,638,444 B2
(45) Date of Patent: May 2, 2023

(54) HOOKAH COMPRISING HIGH FREQUENCY HEATING UNIT

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 345 days.

(21) Appl. No.: 17/096,903

(22) Filed: Nov. 12, 2020

(65) Prior Publication Data

US 2021/0360965 A1 Nov. 25, 2021

(30) Foreign Application Priority Data

May 22, 2020 (CN) ..... 202010447179.0
May 22, 2020 (CN) ..... 202020884883.8

(51) Int. Cl.

| | |
|---|---|
| ***A24F 1/30*** | (2006.01) |
| ***A24F 40/465*** | (2020.01) |
| ***A24F 1/14*** | (2006.01) |
| *A24F 1/32* | (2006.01) |

(52) U.S. Cl.

CPC ..... *A24F 1/30* (2013.01); *A24F 1/14* (2013.01); *A24F 40/465* (2020.01); *A24F 1/32* (2013.01)

(58) Field of Classification Search

CPC ..... A24F 1/30; A24F 40/465
See application file for complete search history.

(56) References Cited

U.S. PATENT DOCUMENTS

2017/0251718 A1* 9/2017 Armoush et al. ..... A24F 1/30

* cited by examiner

*Primary Examiner* — Michael J Felton
*Assistant Examiner* — Ronnie Kirby Jordan
(74) *Attorney, Agent, or Firm* — Matthias Scholl P.C.; Matthias Scholl

(57) ABSTRACT

A hookah, includes a cup assembly and a high frequency heating unit detachably connected to the cup assembly. The cup assembly includes a cup configured to accommodate a tobacco material. The high frequency heating unit includes a hollow handle and a magnetic induction coil disposed in the hollow handle. The hollow handle includes a through hole and the magnetic induction coil includes a central hole concentric with the through hole. The cup is disposed in the through hole of the hollow handle. When in use, an alternating current is introduced to the magnetic induction coil, and a magnetic induction effect is generated, so that the cup is heated and the heat is transferred to the tobacco material whereby the tobacco material is heated and smoke is produced.

11 Claims, 3 Drawing Sheets

HOOKAH COMPRISING HIGH FREQUENCY HEATING UNIT

CROSS-REFERENCE TO RELAYED APPLICATIONS

Pursuant to 35 U.S.C. § 119 and the Paris Convention Treaty, this application claims foreign priority to Chinese Patent Application No. 202010447179.0 filed on May 22, 2020, and to Chinese Patent Application No. 202020884883.8 filed on May 22, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a hookah comprising high frequency heating unit.

A conventional tobacco material heating device comprises a cup and a magnetic induction coil fixedly disposed on the cup. The cup is made of metal or plastics.

SUMMARY

The disclosure provides a hookah comprising a cup assembly and a high frequency heating unit detachably connected to the cup assembly. The cup assembly comprises a cup configured to accommodate a tobacco material; the high frequency heating unit comprises a hollow handle and a magnetic induction coil disposed in the hollow handle; the hollow handle comprises a through hole and the magnetic induction coil comprises a central hole concentric with the through hole; the cup is disposed in the through hole of the hollow handle; when in use, an alternating current is introduced to the magnetic induction coil, and a magnetic induction effect is generated, so that the cup is heated and the heat is transferred to the tobacco material whereby the tobacco material is heated and smoke is produced.

In a class of this embodiment, the hookah further comprises a thermal insulation cup disposed between the cup of the cup assembly and the magnetic induction coil.

In a class of this embodiment, the hookah further comprises a variable frequency power supply and a battery disposed in the hollow handle; an output end of the battery is connected to an input end of the variable frequency power supply for power supply, and an output end of the variable frequency power supply is soldered on the magnetic induction coil; under a power-on state, the variable frequency power supply outputs the alternating current which passes through the magnetic induction coil to generate an induced magnetic field.

In a class of this embodiment, the high frequency heating unit is connected to a 220 V alternating current which is rectified, filtered and depressurized through an adapter and input to the variable frequency power supply; the variable frequency power supply outputs the alternating current which passes through the magnetic induction coil to generate the magnetic induction effect.

In a class of this embodiment, the hookah further comprises an air inlet nozzle disposed on an end face of the cup.

In a class of this embodiment, the cup is glass, ceramics, quartz, crystal, mica, or jade inlaid with metal.

In a class of this embodiment, the air inlet nozzle is glass, ceramics, quartz, crystal, mica, or jade.

In a class of this embodiment, the air inlet nozzle comprises a vertical air channel; an airflow volume of the air inlet nozzle is changeable through covering a part of the air inlet nozzle with a finger.

In a class of this embodiment, the hookah further comprises a smoke filter connected to the cup assembly; wherein when in use, the smoke is filtered by the smoke filter and then inhaled by a user.

In a class of this embodiment, the thermal insulation cup is disposed around the cup.

In a class of this embodiment, the cup comprises an air channel; when in use, air enters the cup via the air inlet nozzle and drives the produced smoke to submerge into the water of the smoke filter via the air channel so that the smoke is filtered by the water.

DETAILED DESCRIPTION

To further illustrate, embodiments detailing a hookah are described below. It should be noted that the following embodiments are intended to describe and not to limit the disclosure.

Principle of high frequency heating: when an alternating current is introduced to a magnetic induction coil, an alternating magnetic field will be generated. When a metal conductor is placed in the alternating magnetic field, an eddy current is produced. The eddy current makes the metal conductor heated.

Tobacco materials refer to smoke oil, tobacco, tobacco and other materials used to produce smoke.

The cup of the disclosure can be made of metal material, or part of the cup is made of metal material, or the cup is made of nonmetal material inlaid with metal material.

Figure 1:
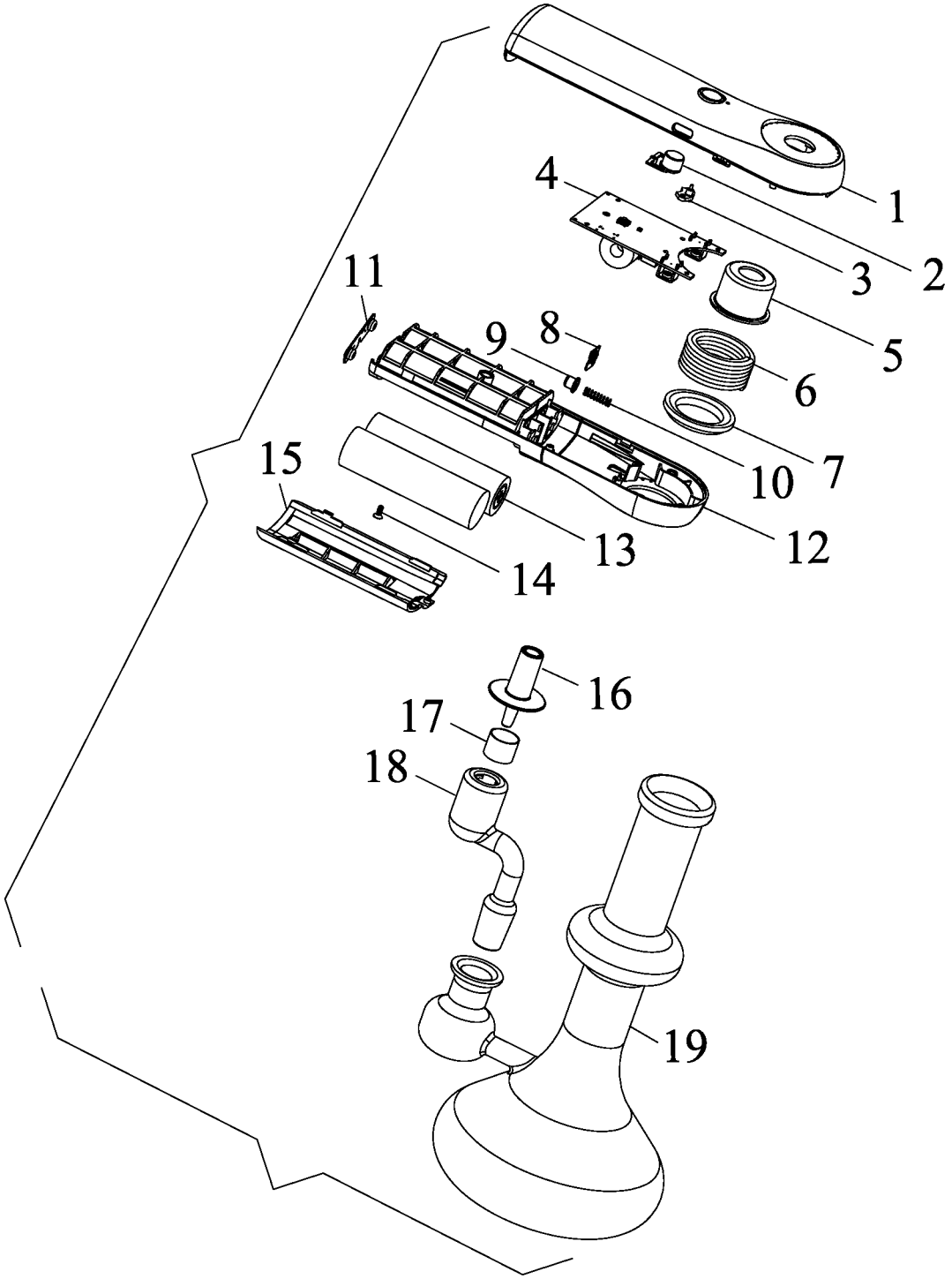
FIG. 1 is an exploded view of a hookah in accordance with one embodiment of the disclosure.
Figure 2:
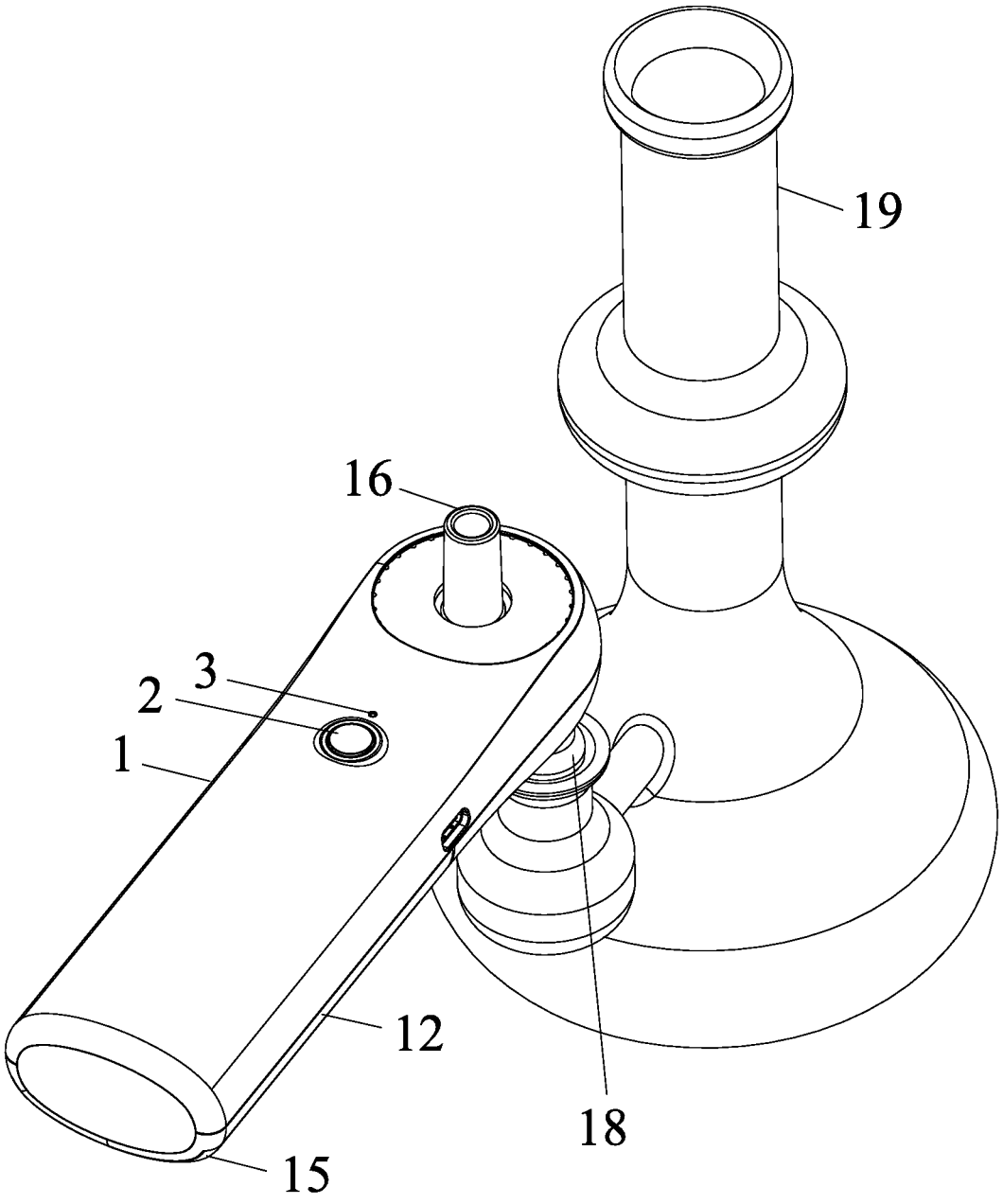
FIG. 2 is a schematic diagram of a hookah in accordance with one embodiment of the disclosure.
Figure 3:
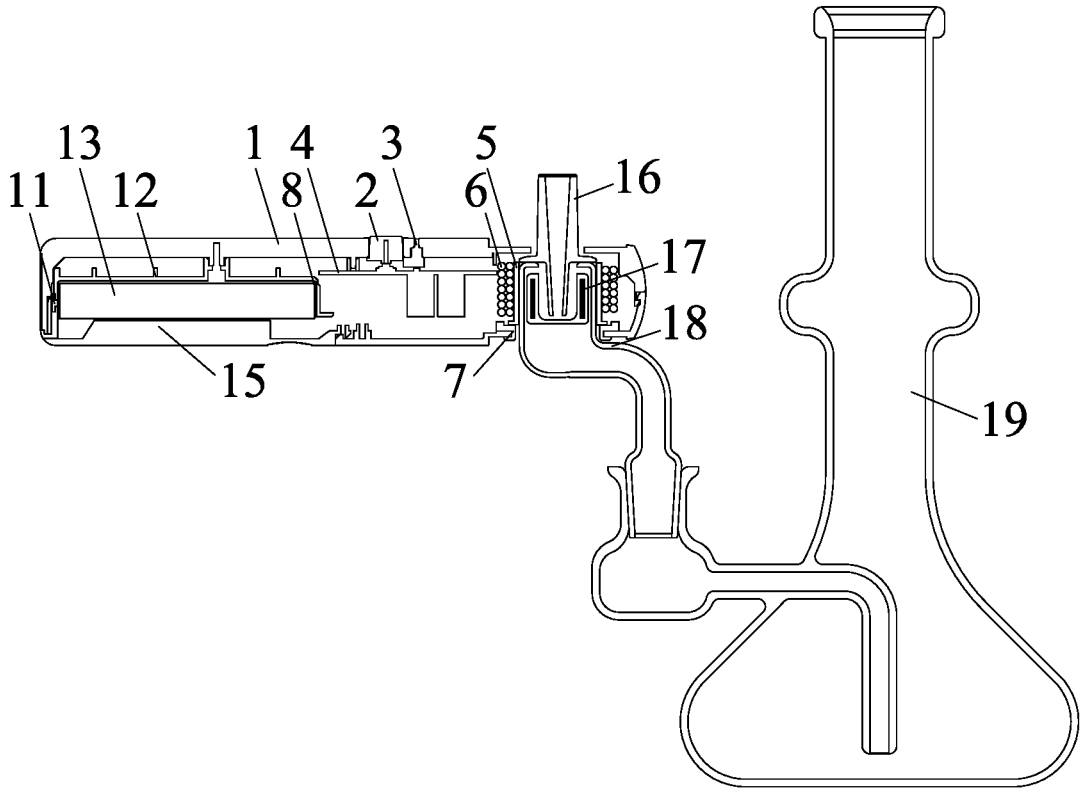
FIG. 3 is a sectional view of a hookah in accordance with one embodiment of the disclosure.

Specifically, as shown in FIGS. 1-3, the disclosure provides a hookah comprising a cup assembly and a high frequency heating unit detachably connected to the cup assembly.

The high frequency heating unit comprises a first cover 1, a power button 2, a transparent screen 3, a variable frequency power supply 4, a thermal insulation cup 5, a magnetic induction coil 6, a silica ring 7, a positive contact 8, a negative contact 9, a spring 10, a connection piece 11, a second cover 2, a battery 13, a screw 14, and a battery cover 15. The thermal insulation cup 5 is disposed inside the magnetic induction coil 6 to insulate and protect the magnetic induction coil 6. The silica ring 7 is disposed on the bottom end of the magnetic induction coil 6 for thermal insulation. The output end of the variable frequency power supply 4 is soldered on the input end of the magnetic induction coil 6 to supply power for the magnetic induction coil 6. The variable frequency power supply 4 and the magnetic induction coil 6 are fixed on the second cover 2.

The power button 2 and the transparent screen 3 are respectively disposed on the switch button and LED indicator light of the variable frequency power supply 4 to switch on the power supply and to indicate the power state of the high frequency heating unit. The connection piece 11 is disposed on one end of the second cover 2 to in series connect the positive and negative electrodes of the battery 13. The spring 10 is disposed on the negative contact 9 and fixed on the second cover 12. The negative contact 9 contacts the negative electrode of the battery 13 through the elastic force of the spring. The positive contact 8 is fixed on the second cover 12 and contacts the positive electrode of the battery 13. The first cover 1 is fixed on the second cover 12 through the screw 14. The power button 2 and the transparent screen 3 are exposed out of the surface of the first cover 1. The battery 13 is disposed in a groove of the second cover, and the positive and negative electrodes of the battery contact the positive contact 8 and the negative contact 9, respectively. The battery cover 15 is disposed on the second cover 12 and covers the battery 13.

The cup assembly comprises an air inlet nozzle 16 and a cup 18. The air inlet nozzle 16 is disposed on the end face of the cup 18. The cup 18 is inlaid with a metal conductor 17. When in use, the cup 18 is disposed on the high frequency heating unit. In the power-on state, an induction magnetic field is formed in the magnetic induction coil 6, and an eddy current is produced in the metal conductor 17 disposed in the magnetic induction coil 6. The eddy current makes the metal conductor 17 heated, and the heat is transferred to the cup 18 to heat the tobacco material in the cup 18 whereby smoke is produced.

In certain embodiments, the hookah further comprises a smoke filter 19 connected to the cup assembly. The cup 18 comprises an air channel; when in use, the air enters the cup 18 via the air inlet nozzle 16 and drives the produced smoke to submerge into the water of the smoke filter via the air channel so that the smoke is filtered by the water and flows to a smoke outlet of the smoke filter, and is inhaled by a user.

In certain embodiments, the high frequency heating unit is connected to a 220 V alternating current which is rectified, filtered and depressurized through an adapter and input to the variable frequency power supply 4; the variable frequency power supply 4 outputs the alternating current which passes through the magnetic induction coil 6 to generate the magnetic induction effect.

The following advantages are associated with the hookah of the disclosure:

1. The hookah comprises a cup assembly and a high frequency heating unit detachably connected to the cup assembly. The tobacco material is heated in the cup assembly and the produced smoke is filtered in the smoke filter, so the hookah is environmentally friendly.

2. The high frequency heating unit is detachably connected to the cup assembly, so that the hookah is easy to carry.

3. The cup of the hookah can be made of nonmetal material inlaid with metal material, which is environmentally friendly.

4. The cup comprises an air channel which allows the air and smoke to pass through, which is a multifunctional design.

It will be obvious to those skilled in the art that changes and modifications may be made, and therefore, the aim in the appended claims is to cover all such changes and modifications.

What is claimed is:

1. A hookah, comprising a cup assembly and a high frequency heating unit detachably connected to the cup assembly; wherein the cup assembly comprises a cup configured to accommodate a tobacco material; the high frequency heating unit comprises a hollow handle and a magnetic induction coil disposed in the hollow handle; the hollow handle comprises a through hole and the magnetic induction coil comprises a central hole concentric with the through hole; the cup is disposed in the through hole of the hollow handle; when in use, an alternating current is introduced to the magnetic induction coil, and a magnetic induction effect is generated, so that the cup is heated and the heat is transferred to the tobacco material whereby the tobacco material is heated and smoke is produced.

2. The hookah of claim 1, further comprising a thermal insulation cup disposed between the cup of the cup assembly and the magnetic induction coil.

3. The hookah of claim 2, further comprising a variable frequency power supply and a battery disposed in the hollow handle; wherein an output end of the battery is connected to an input end of the variable frequency power supply for power supply, and an output end of the variable frequency power supply is soldered on the magnetic induction coil; under a power-on state, the variable frequency power supply outputs the alternating current which passes through the magnetic induction coil to generate an induced magnetic field.

4. The hookah of claim 2, wherein the high frequency heating unit is connected to a 220 V alternating current which is rectified, filtered and depressurized through an adapter and input to the variable frequency power supply; the variable frequency power supply outputs the alternating current which passes through the magnetic induction coil to generate the magnetic induction effect.

5. The hookah of claim 1, further comprising an air inlet nozzle disposed on an end face of the cup.

6. The hookah of claim 5, wherein the cup of the cup assembly is glass, ceramics, quartz, crystal, mica, or jade inlaid with metal.

7. The hookah of claim 6, wherein the air inlet nozzle is glass, ceramics, quartz, crystal, mica, or jade.

8. The hookah of claim 7, wherein the air inlet nozzle comprises a vertical air channel; an airflow volume of the air inlet nozzle is changeable through covering a part of the air inlet nozzle with a finger.

9. The hookah of claim 8, further comprising a smoke filter connected to the cup assembly; wherein when in use, the smoke is filtered by the smoke filter and then inhaled by a user.

10. The hookah of claim 2, wherein the thermal insulation cup is disposed around the cup.

11. The hookah of claim 9, wherein the cup of the cup assembly comprises an air channel; when in use, air enters the cup via the air inlet nozzle and drives the produced smoke to submerge into the water of the smoke filter via the air channel so that the smoke is filtered by the water.

* * * * *